US006484785B2

(12) United States Patent
Dieckmann

(10) Patent No.: US 6,484,785 B2
(45) Date of Patent: Nov. 26, 2002

(54) AWNING

(75) Inventor: Martin Dieckmann, Mettingen (DE)

(73) Assignee: Chmitz-Werke GmbH + Co., Emsdetten (DE)

( * ) Notice: Subject to any disclaimer, the term of this patent is extended or adjusted under 35 U.S.C. 154(b) by 0 days.

(21) Appl. No.: 09/908,726

(22) Filed: Jul. 20, 2001

(65) Prior Publication Data

US 2002/0007921 A1 Jan. 24, 2002

(30) Foreign Application Priority Data

Jul. 22, 2000 (DE) ..... 100 35 796

(51) Int. Cl.[7] ..... E06B 9/00
(52) U.S. Cl. ..... 160/22; 160/66
(58) Field of Search ..... 160/22, 66, 56, 160/57, 58.1, 68, 72, 81, 262, 370.22, 310

(56) References Cited

U.S. PATENT DOCUMENTS 1,809,966 A * 6/1931 Fogh ..... 160/56
1,842,598 A * 1/1932 Fogh ..... 160/56
4,615,371 A * 10/1986 Clauss ..... 160/22
5,170,811 A * 12/1992 Kirk et al. ..... 160/56 X

FOREIGN PATENT DOCUMENTS

DE 29711873 U1 10/1997
DE 19706251 A1 9/1998

* cited by examiner

*Primary Examiner*—David M. Purol
(74) *Attorney, Agent, or Firm*—Browdy and Neimark

(57) ABSTRACT

In an awning having a substantially triangular awning fabric that can be wound onto a roller tube, provision is made for the roller tube to be actuated in the winding direction by a torsion spring that is disposed in a housing together with the roller tube; for the roller tube to be actuated in the pull-out direction by an electric motor that is disposed in the same housing; for a guide rail to be disposed on one end of the housing and a spacer rail to be disposed on the other end of the housing, said guide rail and spacer rail being connected in the region of their free outer ends to one another or to a window frame; for a deflection roller to be disposed in the connecting region of the spacer rail and guide rail; and for a rope or the like to be attached in the region of the triangular cloth tip and deflected via the deflection roller and guided along the guide rail to a rope sheave on the motor.

5 Claims, 1 Drawing Sheet

AWNING

BACKGROUND OF THE INVENTION

1. Field of the Invention

The present invention is directed to an awning having a substantially triangular awning fabric that can be wound onto a roller tube.

2. Background Art

In the case of the so-called triangular shades of the above type, the known products are problematic as they require very precise on-site adjustments, generally resulting in considerable installation costs.

SUMMARY OF THE INVENTION

With this as the starting-point, the invention has as its object to create an awning according to the preamble that allows a pre-assembly at the factory to the greatest possible extent and can, accordingly, be quickly and easily installed at the place of installation and is furthermore characterized by a very reliable operation.

This object is met according to the invention in such a way that the roller tube is actuated in the winding direction by a torsion spring that is disposed in a housing together with the roller tube, that the roller tube can be actuated in the pull-out direction by an electric motor that is disposed in the same housing, that a guide rail is disposed on one end of the housing and a spacer rail on the other end of the housing, and the two can be connected in the region of their free outer ends either to one another or to a window frame, that a deflection roller is disposed in the connecting region of the spacer rail and guide rail, and that a rope or the like is secured in the region of the tip of the triangular cloth and guided, deflected via the deflection roller, along the guide rail to a rope sheave on the motor.

To the extent in which a rope is mentioned in the above, this means, in the most general sense, a deflectable pulling medium, such as, e.g., also a chain, a strap, a belt or the like. This inventive system makes on-site adjustments dispensable and permits delivery of a finished product that merely needs to be hung into a universal holder and can otherwise be fastened with a few screws. The design of the rope pulley permits a defined and even movement of the awning fabric.

A rope deflector is preferably formed in the region of the joint, i.e., in the simplest case, the joint itself serves as a deflection means.

To fasten the rope to the awning fabric, a front rail may be provided in the region of the tip of the triangular cloth, preferably in such a way that the articulated connection is designed displaceable along the front rail in order to thus permit a fine adjustment. This may be implemented with a hook that is slidable inside a groove.

A particularly compact construction is attained in such a way that the torsion spring, the roller tube, and the motor are disposed coaxially inside the housing and the motor is situated on one end and the torsion spring on the other end of the roller tube.

The invention will be explained in more detail below based on a preferred exemplary embodiment in conjunction with the drawing.

DESCRIPTION OF THE PREFERRED EMBODIMENT

Figure 1:
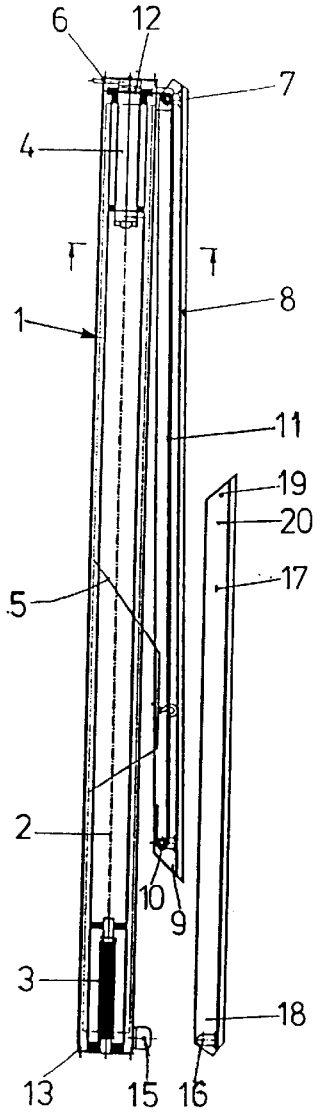
FIG. 1 shows an inventive awning in the condition in which it is delivered.

A triangular shade shown in the drawing is designed as a ready-made awning and comprises a housing 1, in which a roller tube 2, a torsion spring 3, and a motor 4 are disposed coaxially to one another. A nearly triangular awning fabric 5 is wound up on the roller tube 2.

On the one end 6 of the housing, at which the motor 4 is housed as well, a guide rail 8 is pivotally hinged by means of a joint 7, which, at the same time, also serves as a deflection means. On the opposite end 9 of the guide rail 8, a deflection roller 10 is provided for a rope 11, which is guided inside the guide rail 8 and can be wound up by means of a rope sheave 12 driven by the motor 4.

On the end 13 of the housing 1 located opposite the motor-side end 6 and on which the torsion spring 3 is housed, the housing 1 has on its outside a flange-like projection 15 with a bore, to which flange-like projection 15 a spacer rail 17 with a flange-like projection 16 with a corresponding bore can be linked in an articulated manner by means of a screw-type or riveted connection when the awning is installed.

In this installed condition, the spacer rail 17 is thus connected in the region of its inner end 18 to the housing 1, and its outer end 20 is connected via fastening bores 19 and matching screws to the outer end 9 of the guide rail 11 or to a window frame.

On the triangular tip 21 of the awning fabric 5, a front rail 22 is fixed, which has a hook 23 disposed on it that sits with its foot inside a groove and is accordingly displaceable along the arrow 24. The rope 11 is fastened on this hook 23 and deflected by means of the deflection roller 10 and guided along the guide rail 8, then deflected again around the joint 7 and can be wound up onto a rope sheave 12 driven by the motor 4 in order to extend the awning fabric 5 against the force of the torsion spring 3 that acts in the winding direction.

Figure 2:
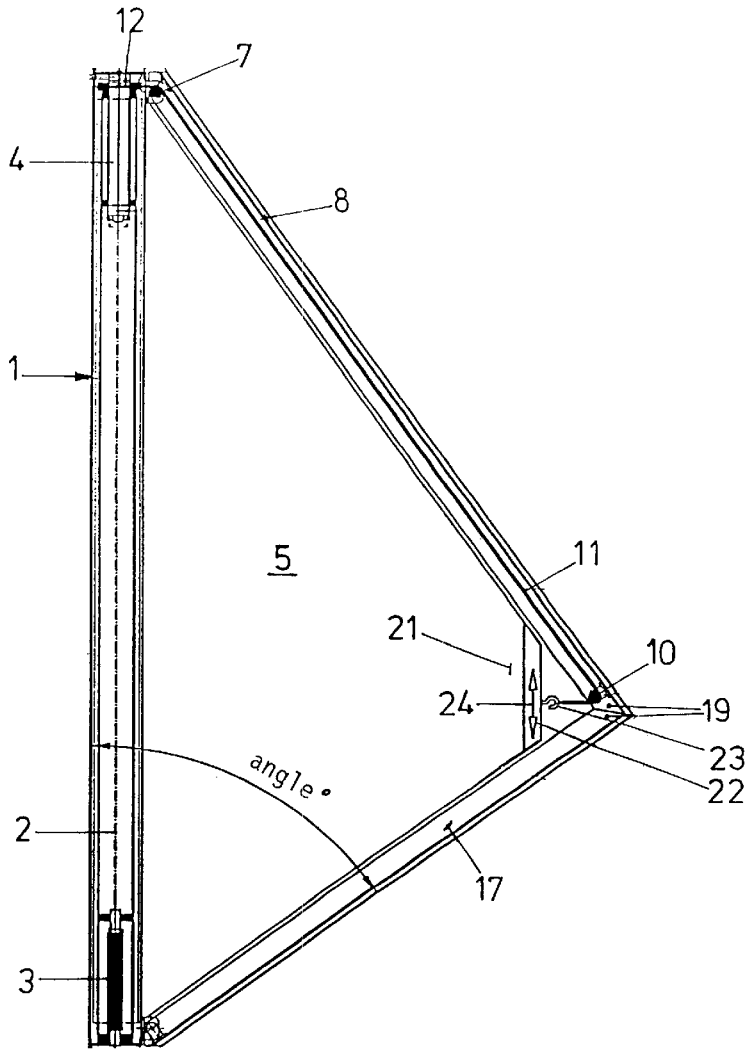
FIG. 2 shows the same awning in its installed condition.

When a customer orders an inventive awning at the factory, he needs to provide only the dimensions of his triangular window area, i.e., measurement 1 according to the base length, measurement 2 according to the length that is defined by the guide rail 2 or its extension, and measurement 3, which is defined by the spacer rail or its extension, as illustrated in FIG. 2. At the factory, the roller tube 2 and housing 1, as well as the guide rail 8 and spacer rail 17 are then dimensioned accordingly, so that on-site, only a universal holder is mounted and the housing 1 is hung into the same, and the spacer rail 17 needs to be connected via the flanges 15, 16 to the housing 1 and via the bores 19 to the guide rail 8 or window frame. The position of the hook 23 is adjusted such that the rope 11 coming from the deflection roller 10 extends perpendicular to the front rail 22. Further fine adjustments can be performed by adjusting the deflection roller 10 on the guide rail 8.

The awning will have been put through a test run at the factory and the stop positions will have been set.

What is claimed is:

1. An awning comprising:

a housing (1) having two ends;

a substantially triangular awning fabric (5) having a tip;

a roller tube (2) for carrying said awning fabric (5); an electric motor (4) for pulling out said awning fabric (5);

a torsion spring (3);

a guide rail (8) having first and second ends;

a spacer rail (17) having first and second ends;

a deflection roller (10);

a rope (11);

a rope sheave (12) carrying said rope and driven by said electric motor; and means for connecting said second ends of said guide rail (8) and said spacer rail (17) to one another or to a window frame, wherein:

said roller tube (2), said torsion spring (3) and said electric motor (4) are all disposed in said housing (1);

said roller tube (2) is actuated in a winding direction by said torsion spring (3);

said first end of said guide rail (8) is pivotally connected to one end of said housing (1) and said first end of said spacer rail (17) is pivotally connected to the other end of said housing (1);

said second ends of said guide rail (8) and said spacer rail (17) define a connecting region and said deflection roller (10) is disposed in said connecting region; and said rope (11) is attached to said tip (21) of said awning fabric, is deflected by said deflection roller (10), and is guided along said guide rail (8)to said rope sheave (12).

2. An awning according to claim 1, further comprising means for deflecting said rope (11) at said first end of said guide rail (8).

3. An awning according to claim 1, further comprising a front rail (22) attached to said triangular cloth tip (21) to form an articulated connection between said rope (11) and said awning fabric.

4. An awning according to claim 3, further comprising means (23) for connecting said rope to said front rail, said means for connecting being displaceable along said front rail (22).

5. An awning according to claim 1, wherein said torsion spring (3), roller tube (2) and motor (4) are disposed coaxially with one another inside said housing (1) and said roller tube (2) is interposed between said motor (4) and said torsion spring (3).

* * * * *

UNITED STATES PATENT AND TRADEMARK OFFICE

CERTIFICATE OF CORRECTION

PATENT NO. : 6,484,785 B2
DATED : November 26, 2002
INVENTOR(S) : Martin Dieckmann It is certified that error appears in the above-identified patent and that said Letters Patent is hereby corrected as shown below:

Title page,
Item [73], delete "Chmitz-Werke" and insert therefor -- Schmitz-Werke --.

Signed and Sealed this

Fourth Day of March, 2003

JAMES E. ROGAN
*Director of the United States Patent and Trademark Office*